US009481430B2

(12) United States Patent
Cheatham, III et al.

(10) Patent No.: US 9,481,430 B2
(45) Date of Patent: Nov. 1, 2016

(54) NATURAL GAS TRANSPORT VESSEL

(71) Applicant: Elwha LLC, Bellevue, WA (US)

(72) Inventors: Jesse R. Cheatham, III, Seattle, WA (US); Tom Driscoll, San Diego, CA (US); Alexander Galt Hyde, Redmond, WA (US); Roderick A. Hyde, Redmond, WA (US); Muriel Y. Ishikawa, Livermore, CA (US); Jordin T. Kare, Seattle, WA (US); Nathan P. Myhrvold, Medina, WA (US); Tony S. Pan, Bellevue, WA (US); Robert C. Petroski, Seattle, WA (US); David R. Smith, Durham, NC (US); Clarence T. Tegreene, Mercer Island, WA (US); Nicholas W. Touran, Seattle, WA (US); Yaroslav A. Urzhumov, Bellevue, WA (US); Charles Whitmer, North Bend, WA (US); Lowell L. Wood, Jr., Bellevue, WA (US); Victoria Y. H. Wood, Livermore, CA (US)

(73) Assignee: Elwha, LLC, Bellevue, WA (US)

( * ) Notice: Subject to any disclaimer, the term of this patent is extended or adjusted under 35 U.S.C. 154(b) by 166 days.

(21) Appl. No.: 14/480,014

(22) Filed: Sep. 8, 2014

(65) Prior Publication Data

US 2016/0068243 A1 Mar. 10, 2016

(51) Int. Cl.

| | |
|---|---|
| ***B63G 8/00*** | (2006.01) |
| ***B63B 25/12*** | (2006.01) |
| ***F17C 5/06*** | (2006.01) |
| *B63B 27/24* | (2006.01) |

(52) U.S. Cl.

CPC ..... *B63G 8/001* (2013.01); *B63B 25/12* (2013.01); *F17C 5/06* (2013.01); *B63B 27/24* (2013.01); *B63G 2008/002* (2013.01); *F17C 2203/0685* (2013.01); *F17C 2221/033* (2013.01); *F17C 2270/0131* (2013.01)

(58) Field of Classification Search

CPC ..... B63G 8/001; B65D 88/78

See application file for complete search history.

(56) References Cited

U.S. PATENT DOCUMENTS

| | | | | |
|---|---|---|---|---|
| 3,085,533 | A * | 4/1963 | Goryl | B63B 25/08 114/244 |
| 3,975,167 | A | 8/1976 | Nierman | |
| 4,846,088 | A | 7/1989 | Fanse et al. | |
| 5,235,928 | A | 8/1993 | Shank, Jr. | |
| 5,803,005 | A | 9/1998 | Stenning et al. | |
| 5,839,383 | A | 11/1998 | Stenning et al. | |
| 6,260,501 | B1 | 7/2001 | Agnew | |
| 6,725,671 | B2 | 4/2004 | Bishop | |
| 6,945,187 | B1 * | 9/2005 | Woodall | B63B 35/285 114/244 |
| 7,155,918 | B1 | 1/2007 | Shivers, III | |
| 7,237,391 | B1 | 7/2007 | Shivers, III | |
| 7,240,499 | B1 | 7/2007 | Shivers, III | |
| 7,610,869 | B2 | 11/2009 | Thomas | |
| 8,091,495 | B2 | 1/2012 | Donnelly et al. | |
| 2002/0046547 | A1 | 4/2002 | Bishop et al. | |
| 2003/0106324 | A1 | 6/2003 | Bishop | |
| 2005/0005831 | A1 | 1/2005 | Krason et al. | |
| 2011/0000546 | A1 | 1/2011 | Baugh | |
| 2013/0266380 | A1 * | 10/2013 | Capron | F16L 1/24 405/184.4 |

OTHER PUBLICATIONS

"Underwater glider"; Wikipedia, the free encyclopedia; printed on Sep. 8, 2014; pp. 1-5; located at en.wikipedia.org/wiki/Underwater_glider.

* cited by examiner

*Primary Examiner* — Stephen Avila

(57) ABSTRACT

A lightweight transport vessel transports compressed natural gas underwater without needing to liquefy the gas for transport.

27 Claims, 2 Drawing Sheets

NATURAL GAS TRANSPORT VESSEL

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)).

PRIORITY APPLICATIONS

None.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In one aspect, a vessel suitable for transporting compressed natural gas (CNG) underwater includes a flexible container configured to hold CNG at an operating pressure and a buoyancy control system configured to adjust a buoyancy of the vessel by moving CNG into or out of the flexible container. The vessel may further include a propulsion system, which may be at least partially powered by burning CNG, such as the CNG in the flexible container. Moving CNG into or out of the flexible container may include moving it into or out of a high-pressure tank, liquefying at least a portion of the CNG, converting at least a portion of the CNG to hydrates, or combusting at least a portion of the CNG. The vessel may store CNG in a plurality of compartments, which may be separated by flexible walls and may be independently sealable. The vessel may include ballast, which may be jettisoned to increase the buoyancy of the vessel. The vessel may include an umbilical hose configured to reach the surface, for example to import air or oxygen, which may be combusted with at least a portion of the CNG. The compartment may have a variable shape which may be controlled by controllable tensile members (e.g., electroactive fibers, drawstrings, fibers, rollers, plates, levers, springs, or rods), which may be configured to adjust a lateral or longitudinal cross-section of the compartment, to adjust hydrodynamic forces, or to adjust the shape of the container to facilitate connection to a fuel transfer system. The operating pressure may substantially match the ambient pressure of the water at the depth of the vessel. The flexible container may have a structural failure point that is less than the operating pressure, such as 20% of the operating pressure or 5% of the operating pressure. At least a portion of the an outside wall of the flexible container may include a structural reinforcement.

In another aspect, a method of transporting CNG includes placing CNG in a vessel at a source location, maneuvering the vessel to a destination location, and removing the CNG from the vessel at the destination location. The vessel includes a flexible container configured to hold CNG at an operating pressure and a buoyancy control system configured to adjust a buoyancy of the vessel by moving CNG into or out of the flexible container. Maneuvering the vessel may include towing or propelling the vessel (e.g., by combusting at least a portion of the CNG in the vessel), and may include maintaining the vessel at a desired depth by adjusting the buoyancy of the vessel using the buoyancy control system. Adjusting the buoyancy of the vessel may include pumping CNG into or out of a high-pressure tank, liquefying at least a portion of the CNG, converting at least a portion of the CNG into or out of hydrates. Placing CNG in the vessel may include pumping it into the flexible container, and removing CNG from the vessel may include pumping it out of the flexible container. The flexible container may include a plurality of compartments, and adjusting the buoyancy may include moving CNG from one compartment to another. The vessel may include a quantity of ballast, and adjusting the buoyancy may include jettisoning at least a portion of the ballast. Maneuvering the vessel may include maintaining it at a depth where ambient water pressure is maintained in a range around the operating pressure, such as ±20%, ±5%, or about at the operating pressure. The vessel may include an umbilical hose configured to reach the surface and to import air or oxygen, and the method may include combusting at least a portion of the CNG with the air or oxygen so imported. Maneuvering the vessel may include adjusting a shape of the vessel. The vessel may have a variable shape configured to be controlled by controllable tensile members (e.g., electroactive fibers, drawstrings), for example to adjust hydrodynamic forces or to adjust the variable shape to facilitate connection to a fuel transfer system.

In another aspect, a station for preparing CNG includes a CNG source configured to deliver CNG to a location at a shallow depth (e.g., at the surface or less than about 100 meters), a conduit configured to transport CNG to a deep depth (e.g., more than about 200 meters or more than about 500 meters), and a fitting configured to attach to a CNG transport vessel to allow CNG to be transferred to a flexible container in the vessel at the deep depth. The flexible container may be compressed to about the ambient water pressure at the deep depth. The station may include a pump powered by burning CNG. The vessel may include a high-pressure tank, and the station may be configured to place a first portion of CNG in the high-pressure tank and a second portion in the flexible container.

In another aspect, a system for transporting CNG from a first to a second location includes a source station, a transport vessel, and a destination station. The source station includes a CNG source configured to deliver CNG to a location at a first shallow depth (e.g., at the surface or less than about 100 meters), a source conduit configured to transport CNG to a first deep depth (e.g., more than about 200 meters or more than about 500 meters), and a source fitting configured to attach to a CNG transport vessel. The vessel includes a flexible container for holding CNG, a vessel fitting configured to attach to the source fitting to allow CNG to be transferred to the flexible container at the first deep depth, and a propulsion system configured to propel the vessel from the first location to the second location. The destination station includes a destination fitting configured to attach to the vessel fitting to receive CNG from the vessel. The vessel fitting may include a plurality of connectors, in which case the connectors used at the source station and the destination station may be the same or different. The destination station may include a CNG storage unit or equipment powered by CNG. CNG in the flexible container may be compressed to about the ambient water temperature at the first deep depth. The propulsion system may include a propeller, or a towing vessel (e.g., a submersible vessel or a surface vessel), which may be configured to tow a plurality of transport vessels. The transport vessel may include a high-pressure tank, and the source station may be configured to place a first portion of CNG in the high-pressure tank and a second portion in the flexible container. The destination fitting may be configured to receive CNG at a second deep depth (e.g., about the same as the first deep depth), and the destination station may include a conduit configured to transport CNG to a second shallow depth (e.g., about at the surface).

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
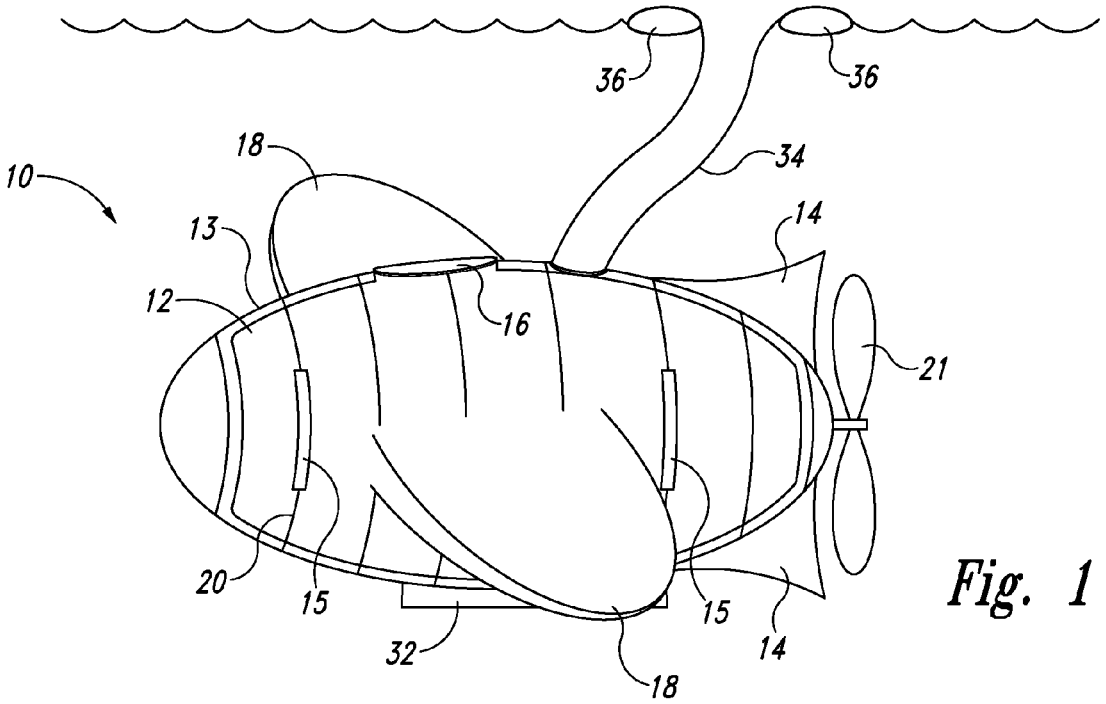
FIG. 1 is a schematic of a transport vessel.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a schematic showing a compressed natural gas (CNG) transport vessel 10. The illustrated vessel includes a generally ellipsoidal body 12 with flexible envelope 13, optional stabilizing fins 14, a fitting 16 for admitting CNG into or out of body 12, optional hydrodynamic "wings" 18, optional reinforcements 20, and optional propeller 21. While propeller 21 is shown at the rear of vessel 10, in other embodiments in may be mounted at the front of vessel 10. In some embodiments, multiple propellers may be used, for example at the front, the back, or the sides of vessel 10. In some embodiments, vessel 10 may travel without the use of a propeller; for example, it may use a water jet propulsion system or a magnetohydrodynamic engine, or it may be towed by an external vehicle such as a surface vehicle or a submersible vehicle (not shown). The interior of the vessel is shown schematically in FIG. 2. CNG is stored within body 12, which may include a single compartment, or may have multiple compartments separated by flexible walls. Barrier 22 defines high-pressure compartment 24 in which CNG can be stored at a higher pressure than in body 12. While compartment 24 is shown at one end of the vessel for simplicity of illustration, in other embodiments, it may be placed in the center of the vessel or multiple compartments may be placed in different regions of the vessel to maintain hydrodynamic stability. In the illustrated embodiment, barrier 22 is flexible, but rigid barriers are also contemplated in some embodiments (e.g., a rigid tank 24 within or external to vessel 10). Internal pump 26 can move CNG between body 12 and compartment 24. In some embodiments, CNG may be liquefied or hydrated when placed in compartment 24. Flexible envelope 13 may include a single layer or multi-layer membrane. The membrane may include a plastic film, such as HDPE, UHMWPE, PEEK, Kapton, Teflon, Mylar, or the like. Envelope 13 may include multiple layers, in which case each layer may have separate design responsibilities. For example, one membrane layer may provide low natural gas (NG) permeability, while another, outer membrane may provide salt water corrosion protection. In some embodiments, the membrane may include thin coatings on the inner and/or outer surfaces, for example, a metal coating to reduce NG permeability, or a coating to enhance corrosion resistance to salt water. Envelope 13 may incorporate high strength fibers or tape for structural reinforcement; they may be a substitute for or in addition to reinforcements 20. Such fibers or tape may be integral to the membrane (e.g., for overall strength or as rip-stops to limit tearing), or may form a separate structural layer from that of the membrane. Such a layer may form a uniform net, or have a nonuniform configuration (e.g., gore and load tape/fiber designs similar to those used in high altitude balloons). Envelope 13 may be laterally divided into multiple sections, for example to enhance reliability and limit failure due to tears or punctures.

In some embodiments, optional internal pumps 28 can move CNG into or out of wings 18, for example to provide underwater glider-style propulsion as discussed below. In some embodiments, wings 18 may not be used for CNG storage, but only for steering or for propulsion. Reinforcements 20 may lie along the surface of envelope 13 (e.g., circumferentially as shown, or axially). Reinforcements 20 may lie within the interior of body 12, attaching to envelope 13 and structurally supporting it. Reinforcements 20 may include active components for maintaining or modifying the shape of the vessel, for example at different operating pressures or in the presence of different currents. Active components 15 may be implemented, for example, using controllable tensile members including fiber "drawstrings" to apply force (in-plane or out-of-plane) to the flexible envelope 13. The fiber drawstrings may include electroactive fibers for direct tensile control. The length or tension in the fiber drawstrings may be controlled by a motor acting directly on the fiber or via mechanisms such as rollers, reels, levers, or the like. Active components 15 may include rigid elements (such as rods, levers, or plates) or semi-rigid ones (such as springs) to apply controllable forces to reinforcements 20. Fitting 16 is illustrated at the top of vessel 10 for ease of illustration, but may easily be placed in any convenient location, such as the nose or tail of the vessel (especially if optional propeller 21 is omitted from the tail). Motor 30, if included, is configured to drive propeller 21. In some embodiments, motor 30 runs on CNG, which it may draw directly from body 12 or compartment 24. Pumps 26, 28 may also optionally be powered by CNG from the vessel payload.

In some embodiments, vessel 10 may include ballast 32, which may be used to counteract the buoyancy forces resulting from the CNG stored in body 12. In some embodiments, ballast 32 may be jettisoned in whole or in part when the vessel needs to rise in the water. It may further include optional umbilical 34, which may include a flotation device 36 allowing it to float at the surface. Umbilical 34 allows vessel 10 to draw air or oxygen from the surface, which in some embodiments, it may combust with a portion of the CNG payload or with other fuel, for example in order to run motor 30 or pumps 26, 28. The illustrated umbilical 34 is separate from fitting 16 for ease of understanding, but in some embodiments, the same opening may be used for loading or unloading CNG and for drawing air or oxygen, with these different materials being routed to their appropriate destinations within vessel 10. Umbilical 34 may be retractable, for example so that it need be deployed only when the vessel requires power, or when the seas are calm enough for it to be used.

In some embodiments, vessel 10 may be configured to use underwater glider-style propulsion, in which buoyancy forces are used to produce propulsion of the vessel. (See en.wikipedia.org/wiki/Underwater_glider, which is incorporated by reference herein.) Underwater gliders have the advantage of using relatively little energy to travel long distances underwater, although they sometimes are not as fast or nimble as other underwater vessels. The buoyancy of vessel 10 may be adjusted, for example, by pumping CNG into and out of compartment 24. The vessel responds to the buoyancy change, for example by rising or falling in the water, and wings 18 are angled to convert the vertical hydrodynamic force into forward motion. In some embodiments where wings 18 are also used for CNG storage, their angle may be adjusted by moving CNG into or out of the wings. Alternatively or in addition, the angle of the wings may be mechanically adjusted. The overall shape of the vessel (including the wings, if desired) may also be adjusted using active components 15. In some embodiments, these members may include electroactive fibers or other components allowing them to compress or expand the vessel. They may also be used to change the shape of the vessel to facilitate docking to load or unload CNG, to reduce or increase drag, to reduce or increase lateral forces due to currents, etc. In some embodiments, the overall shape of body 12 can be adjusted by active components 15 to generate positive or negative lift forces; these can be used for vertical motion (e.g., to augment or replace wings 18, to increase or decrease depth, etc.) or for horizontal motion (e.g., to augment or replace fins 14, for steering, to resist currents, etc.).

The presence of CNG stored with body 12 provides a buoyancy force on vessel 10, which may be counteracted by the weight of vessel components such as envelope 13, propeller 21, ballast 32, and the like. In order to actively control the depth of vessel 10 (e.g., to maintain it at a specific depth or to move it up or down), the magnitude of the CNG buoyancy can be varied by moving some amounts of CNG, for example into or out of body 12. In some embodiments, CNG can be moved between high pressure compartment 24 and body 12; as less CNG is in body 12 (and the total gas-filled volume of vessel 10 contracts), buoyancy is reduced, while when more CNG is in body 12 (and the total gas-filled volume of vessel 10 expands), buoyancy is increased. In some embodiments, CNG can be moved into or out of body 12 by converting it to or from a higher density form. In some embodiments, the higher density form is liquid natural gas (LNG), for example stored in a refrigerated and insulated tank 24. In some embodiments, the higher density form is a water-NG hydrate stored in a tank 24, for example under controlled temperature and pressure conditions for which the hydrate is stable or metastable. In some embodiments, CNG can be removed from body 12 by discharging it into the surrounding water. In some embodiments, CNG can be removed from body 12 by combusting it with air or oxygen (e.g., imported via umbilical 34). This combustion can be used to reduce buoyancy either via export of the produced $CO_2$ from the vessel or incorporation of the produced $CO_2$ into water-$CO_2$ hydrates. In some embodiments, the temperature increase resulting from CNG combustion can be used to decrease the CNG density and increase buoyancy (at least until thermal re-equilibration with the surrounding water occurs).

Figure 2:
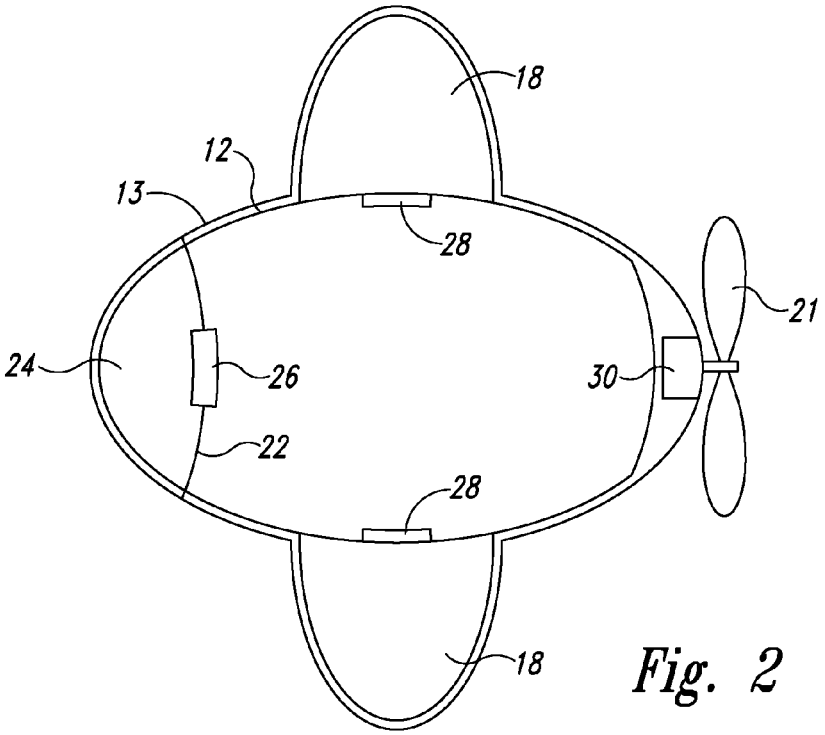
FIG. 2 is a schematic of the interior of the transport vessel shown in FIG. 1.

One advantage of the vessel illustrated in FIG. 1 and FIG. 2 is that it can be made relatively cheaply and can operate without liquefying CNG (or, in some embodiments, liquefying only a portion of the CNG). As discussed below in connection with the docking station illustrated in FIG. 3, the vessel may be filled, emptied, and operated at an operating depth without needing to surface. In some embodiments, the water pressure at the operating depth is employed to at least partially balance the operating pressure of the CNG. In such embodiments, the flexible walls of envelope 13 are not required to resist the full pressure loads from the stored CNG, but such loads can be (at least partially) balanced by the external water pressure, thereby reducing the structural requirements of envelope 13. This effect can be used to reduce the structural failure point of body 12 and its flexible envelope 13 from a value at or above the operating pressure of the CNG to a much lower value, such as less than 20% of the operating pressure, or even to less than 5% of the operating pressure. Such reductions can be useful in reducing the thickness, mass, and cost of envelope 13, and hence of vessel 10. In some embodiments, a structural failure point is selected to be a specified fraction of the desired operating pressure of the CNG, and this can be used to define a nominal operating depth of vessel 10, as well as a range of operating depths about this nominal value. For example, the desired CNG operating pressure can be selected as 50 bars. Assuming (for ease of calculation) a pressure lapse of 1 bar per 10 meters, this would be fully balanced at a depth of 500 meters. In an example embodiment, suppose that body 12 and envelope 13 are designed for a structural failure point of 6% of the 50 bar operating pressure, i.e., 3.0 bar. In this embodiment, vessel 10 may be operated at a nominal depth of 485 meters (rather than at 500 meters). At this depth, body 12 experiences an overpressure of 1.5 bars; this overpressure can be useful in maintaining envelope 13 in tension and in controlling the shape of envelope 13, body 12, and vessel 10. In such an embodiment, the vessel walls may be thin enough that if the vessel were to surface (or even rise to a water level below the surface but above 470 meters), the pressure of CNG inside it would cause it to burst. Nevertheless, it is safe to operate at the operating depth and for a limited range (e.g., plus/minus 15 meters) about this depth.

Figure 3:
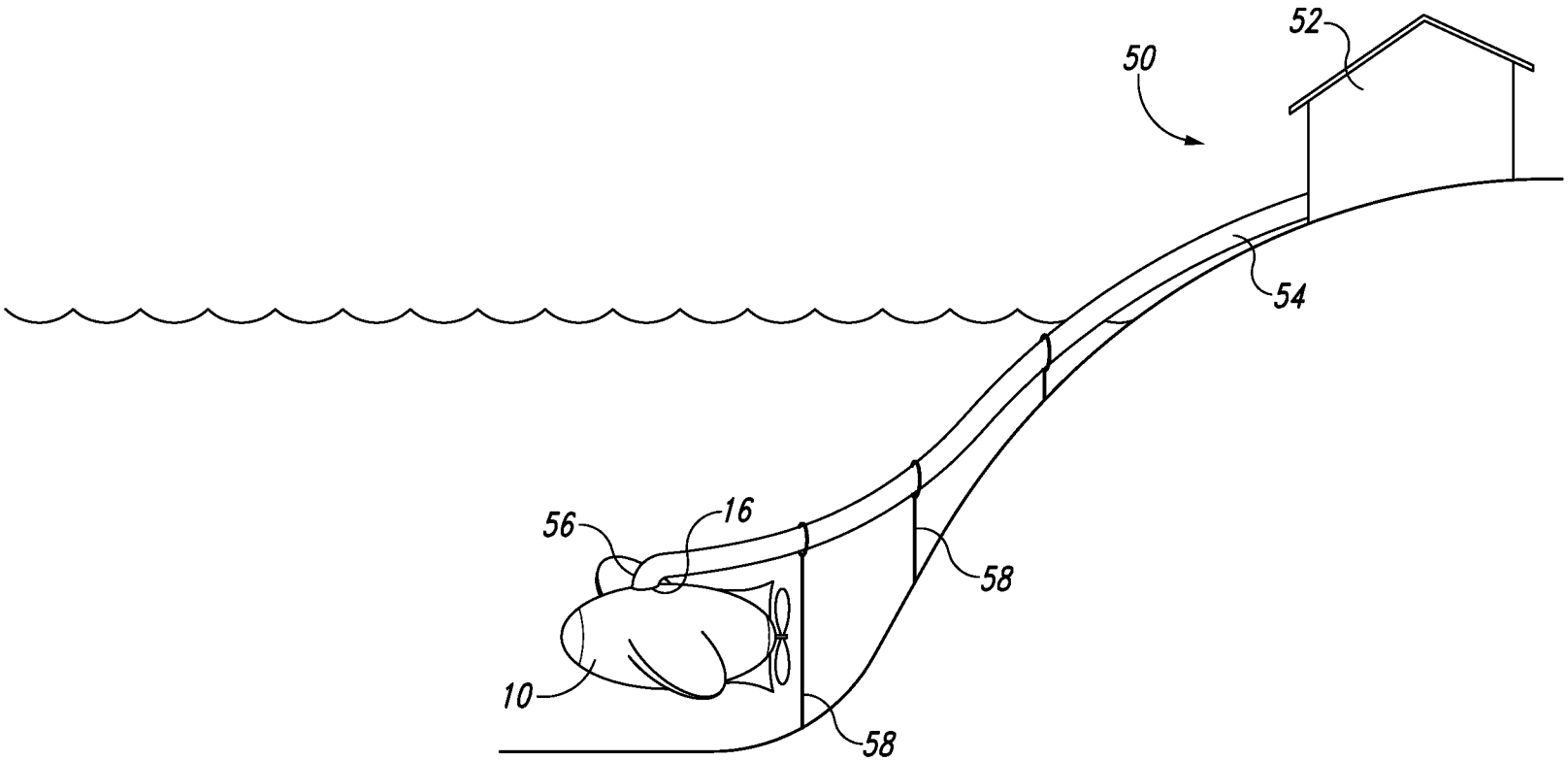
FIG. 3 is a schematic of a transport station for transferring fuel into or out of a vessel.

FIG. 3 is a schematic of a land-based docking station 50 configured for use with the vessel illustrated in FIG. 1 and FIG. 2. It is also contemplated that a similar docking system may be sea-based, for example to deliver CNG to a ship at sea. CNG source 52 may be any land-based CNG repository. CNG is delivered to vessel 10 through conduit 54, which reaches from above or near the surface (e.g., at depths of zero, at depths above 10 meters, at depths above 50 meters, at depths above 100 meters, etc.) to a deep depth (e.g., greater than 100 meters, greater than 200 meters, greater than 500 meters, greater than 1000 meters, etc.). In some embodiments, this deep depth may be substantially the same as an operating depth of vessel 10. In some embodiments, vessel 10 is configured to stay at substantially the same depth throughout operation, while in other embodiments, vessel 10 is configure to dive to a deeper depth after it is disconnected from conduit 54 (or, alternatively, to rise to a shallower depth). Fitting 56 is configured to mate with vessel fitting 16 to allow CNG to be pumped into the vessel. When vessel 10 is loaded as much CNG as desired, fittings 16, 56 are disconnected and sealed so that vessel 10 may depart. Anchors 58 are installed to keep conduit 56 in a fixed location at an appropriate depth for filling transport vessels 10. In some embodiments, a second land-based or sea-based docking station is provided for unloading CNG from vessel 10 into a second land-based repository or CNG-consuming facility.

It will be understood by those within the art that, in general, terms used herein, and especially in the appended claims, are generally intended as "open" terms (e.g., the term "including" should be interpreted as "including but not limited to"; the term "having" should be interpreted as "having at least"; the term "includes" should be interpreted as "includes but is not limited to"; etc.). It will be further understood by those of ordinary skill in the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two pumps," without other modifiers, typically means at least two pumps, or two or more pumps). It will be further understood by those within the art that typically a disjunctive word or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Various embodiments of devices and methods have been described herein. In general, features that have been described in connection with one particular embodiment may be used in other embodiments, unless context dictates otherwise. For the sake of brevity, descriptions of such features have not been repeated, but will be understood to be included in the different aspects and embodiments described herein.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A vessel suitable for transporting compressed natural gas (CNG) underwater, comprising:

a flexible container configured to hold CNG at an operating pressure; and a buoyancy control system configured to adjust a buoyancy of the vessel by moving CNG into or out of the flexible container, wherein moving CNG into or out of the flexible container includes converting at least a portion of the CNG into or out of hydrates.

2. A vessel suitable for transporting compressed natural gas (CNG) underwater, comprising:

a flexible container configured to hold CNG at an operating pressure;

a buoyancy control system configured to adjust a buoyancy of the vessel by moving CNG into or out of the flexible container; and an umbilical hose configured to reach the surface while the vessel is underwater, wherein the umbilical hose is configured to permit the vessel to import air or oxygen from the surface.

3. A method of transporting compressed natural gas (CNG), comprising:

at a source location, placing CNG in a vessel, the vessel including:

a flexible container configured to hold CNG at an operating pressure; and a buoyancy control system configured to adjust a buoyancy of the vessel by moving CNG into or out of the flexible container;

propelling the vessel to a destination location; and removing the CNG from the vessel at the destination location, wherein propelling the vessel includes combusting at least a portion of the CNG in the vessel.

4. A method of transporting compressed natural gas (CNG), comprising:

at a source location, placing CNG in a vessel, the vessel including:

a flexible container configured to hold CNG at an operating pressure; and a buoyancy control system configured to adjust a buoyancy of the vessel by moving CNG into or out of the flexible container;

maneuvering the vessel to a destination location; and removing the CNG from the vessel at the destination location, wherein maneuvering the vessel includes maintaining the vessel at a desired depth by adjusting the buoyancy of the vessel using the buoyancy control system.

5. A method of transporting compressed natural gas (CNG), comprising:

at a source location, placing CNG in a vessel, the vessel including:

a flexible container configured to hold CNG at an operating pressure; and a buoyancy control system configured to adjust a buoyancy of the vessel by moving CNG into or out of the flexible container;

maneuvering the vessel to a destination location; and removing the CNG from the vessel at the destination location, wherein the vessel further includes an umbilical hose configured to reach the surface while the vessel is underwater and to import air or oxygen from the surface, and further comprising combusting at least a portion of the CNG with air or oxygen from the umbilical hose.

6. A method of transporting compressed natural gas (CNG), comprising:

at a source location, placing CNG in a vessel, the vessel including:

a flexible container configured to hold CNG at an operating pressure; and a buoyancy control system configured to adjust a buoyancy of the vessel by moving CNG into or out of the flexible container;

maneuvering the vessel to a destination location; and removing the CNG from the vessel at the destination location, wherein maneuvering the vessel to a destination location includes adjusting a shape of the vessel.

7. A system for transporting compressed natural gas (CNG) from a first location to a second location, the system comprising:

a source station at the first location including:

a CNG source configured to deliver CNG to a location at a first shallow depth;

a source conduit configured to transport CNG to a first deep depth from the first shallow depth; and a source fitting at the first deep depth configured to attach to a CNG transport vessel;

a transport vessel including:

a flexible container for holding CNG;

a vessel fitting configured to attach to the source fitting to allow CNG to be transferred to the flexible container at the first deep depth; and a propulsion system configured to propel the vessel from the first location to the second location; and a destination station at the second location including:

a destination fitting configured to attach to the vessel fitting to receive CNG from the vessel.

8. The system of claim 7, wherein the vessel fitting includes a plurality of connectors.

9. The system of claim 8, wherein the vessel uses the same connector at the source station and at the destination station.

10. The system of claim 8, wherein the vessel uses different connectors at the source station and at the destination station.

11. The system of claim 7, wherein the destination station further includes a CNG storage unit.

12. The system of claim 7, wherein the destination station further includes equipment powered by CNG.

13. The system of claim 7, wherein the first shallow depth is about at the surface.

14. The system of claim 7, wherein the first shallow depth is less than about 100 meters.

15. The system of claim 7, wherein the first deep depth is at least about 200 meters.

16. The system of claim 7, wherein the first deep depth is at least about 500 meters.

17. The system of claim 7, wherein the CNG in the flexible container is compressed to about the ambient water pressure at the first deep depth.

18. The system of claim 7, wherein the propulsion system includes a propeller.

19. The system of claim 7, wherein the propulsion system includes a towing vessel.

20. The system of claim 19, wherein the towing vessel is submersible.

21. The system of claim 19, wherein the towing vessel is configured for travel on the water surface.

22. The system of claim 19, wherein the towing vessel is configured to tow a plurality of transport vessels.

23. The system of claim 7, wherein the transport vessel further includes a high-pressure tank, and wherein the source station is configured to allow a first portion of the CNG to be placed in the high-pressure tank and a second portion of the CNG to be placed in the flexible container.

24. The system of claim 7, wherein the destination fitting is configured to receive CNG from the vessel at a second deep depth.

25. The system of claim 24, wherein the second deep depth is about at the first deep depth.

26. The system of claim 24, wherein the destination station comprises a destination conduit configured to transport CNG from the second deep depth to a second shallow depth.

27. The system of claim 26, wherein the second shallow depth is about at the surface.

* * * * *